US010294783B2

(12) United States Patent
Jones et al.

(10) Patent No.: US 10,294,783 B2
(45) Date of Patent: May 21, 2019

(54) SELECTABLE SIZE SAMPLING APPARATUS, SYSTEMS, AND METHODS

(71) Applicant: Halliburton Energy Services, Inc., Houston, TX (US)

(72) Inventors: Christopher Michael Jones, Houston, TX (US); Wei Zhang, Houston, TX (US); Robert Atkinson, Conroe, TX (US); Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 317 days.

(21) Appl. No.: 14/427,855

(22) PCT Filed: Oct. 23, 2012

(86) PCT No.: PCT/US2012/061454
§ 371 (c)(1),
(2) Date: Mar. 12, 2015

(87) PCT Pub. No.: WO2014/065782
PCT Pub. Date: May 1, 2014

(65) Prior Publication Data
US 2015/0226060 A1 Aug. 13, 2015

(51) Int. Cl.
*E21B 49/08* (2006.01)

(52) U.S. Cl.
CPC ..... *E21B 49/08* (2013.01); *E21B 49/081* (2013.01)

(58) Field of Classification Search
CPC ..... E21B 49/08; E21B 49/081
See application file for complete search history.

(56) References Cited

U.S. PATENT DOCUMENTS 2,728,397 A 12/1955 Walter
3,859,851 A 1/1975 Urbanosky
(Continued)

FOREIGN PATENT DOCUMENTS

AU 2012392987 A1 4/2015
CA 2401375 A1 8/2001
(Continued)

OTHER PUBLICATIONS

"Canadian Application Serial No. 2,888,758, Response filed Aug. 30, 2016 to Office Action dated Mar. 31, 2016", 20 pgs.
(Continued)

*Primary Examiner* — Justin Seo
*Assistant Examiner* — John M Royston
(74) *Attorney, Agent, or Firm* — Gilliam IP PLLC

(57) ABSTRACT

In some embodiments, an apparatus and a system, as well as a method and an article, may operate to terminate sampling of fluid into one of a set of fluid sampling chambers sharing a common inflow sampling line by operating a set of closure mechanisms. Further activity may include initiating sampling of the fluid into another one of the set of fluid sampling chambers, wherein the fluid sampling chambers are configured to sample the fluid in the sampling line in a selected sequence, such that filling a prior fluid sampling chamber as part of the sequence enables sampling in the next fluid sampling chamber as part of the sequence, and wherein the closure mechanisms comprise individual check valves 10 and a common diversion valve or individual diversion valves. Additional apparatus, systems, and methods are disclosed.

22 Claims, 7 Drawing Sheets

(56) References Cited

U.S. PATENT DOCUMENTS

| | | | | |
|---|---|---|---|---|
| 4,583,595 | A | 4/1986 | Czernichow et al. | |
| 4,940,088 | A | 7/1990 | Goldschild | |
| 5,353,637 | A * | 10/1994 | Plumb | E21B 49/008 166/101 |
| 6,189,392 | B1 | 2/2001 | Schultz | |
| 6,439,307 | B1 | 8/2002 | Reinhardt | |
| 6,668,924 | B2 | 12/2003 | Bolze et al. | |
| 7,243,536 | B2 | 7/2007 | Bolze et al. | |
| 7,596,995 | B2 | 10/2009 | Irani et al. | |
| 7,775,276 | B2 | 8/2010 | Pelletier et al. | |
| 8,731,848 | B2 | 5/2014 | Jones et al. | |
| 2002/0084072 | A1 | 7/2002 | Bolze et al. | |
| 2004/0216874 | A1 | 11/2004 | Grant et al. | |
| 2007/0101808 | A1 | 5/2007 | Irani et al. | |
| 2008/0257031 | A1 | 10/2008 | Irani et al. | |
| 2011/0011583 | A1 | 1/2011 | Niconoff | |
| 2012/0073808 | A1 | 3/2012 | Irani et al. | |
| 2012/0097385 | A1 * | 4/2012 | Villareal | E21B 49/081 166/162 |

FOREIGN PATENT DOCUMENTS

| | | | |
|---|---|---|---|
| CN | 2174564 | Y | 8/1994 |
| CN | 102518621 | A | 6/2012 |
| EP | 0534732 | A1 | 3/1993 |
| GB | 577947 | A | 6/1946 |
| WO | WO-2011/159304 | A1 | 12/2011 |
| WO | WO-2014/065782 | A8 | 5/2014 |
| WO | WO-2014065782 | A1 | 5/2014 |

OTHER PUBLICATIONS

"European Application Serial No. 12887145.6, Extended European Search Report dated Sep. 13, 2016", 12 pgs.

"Gulf Cooperation Council Application Serial No. 2013-25649, First Examiner Report dated Dec. 8, 2016.", 5 pages.

"International Application Serial No. PCT/US2012/061454, International Preliminary Report on Patentability dated May 7, 2015", 8 pgs.

"International Application Serial No. PCT/US2012/061454, International Search Report dated Jan. 18, 2013", 2 pgs.

"International Application Serial No. PCT/US2012/061454, Written Opinion dated Jan. 18, 2013", 6 pgs.

Halliburton, "Wireline and Perforating Services", [Online] Retrieved From Internet: <http://www.halliburton.com/public/Ip/contents/Data_Sheets/web/H/HO1961.pdf, (Feb. 2008), 1-2.

"Canadian Application Serial No. 2,888,758, Office Action dated Mar. 31, 2016", 3 pgs.

"European Patent Application Serial No. 12887145.6, Office Action dated Jun. 30, 2015", 2 pgs.

"European Patent Application Serial No. 12887145.6, Reply filed Nov. 5, 2015 to Office Action dated Jun. 30, 2015", 9 pgs.

Mexican Application Serial No. MX/a/2015/004674; Mexican Office Action; dated Apr 25, 2018, 3 pages.

* cited by examiner

SELECTABLE SIZE SAMPLING APPARATUS, SYSTEMS, AND METHODS

PRIORITY APPLICATIONS

This application is a U.S. National Stage Filing under 35 U.S.C. 371 from International Application No. PCT/US2012/061454, filed on 23 Oct. 2012, and published as WO 2014/065782 A1 on 1 May 2014, which applications and publication are incorporated herein by reference in their entirety.

BACKGROUND

Sampling programs are often conducted in the oil field to reduce risk. For example, down hole sampling during the formation evaluation stage of field development can be used to provide representative subsurface formation fluids for analysis. The purpose of the analysis includes determination of bulk fluid properties and phase behavior, as well as geochemistry, flow assurance, assay for oil valuation, compatibility studies, and reservoir compartmentalization and continuity studies. The resulting data can be used to book reserves, and to design production strategies, enhanced oil recovery strategies, and surface handling facilities, et cetera.

Depending on the purpose of the sampling, it may be useful to obtain a variety of sizes and numbers of samples. Often only one bulk fluid sample is required from a reservoir section, with other sections having a largely reduced requirement. For example, pressure-volume-temperature (PVT) work may require only 200 mL in a sample to produce useful results. For analytical work, only 40 mL may be needed. In some cases, even these quantities are sufficient for multiple, repeated analyses because advanced analysis techniques can provide complete geochemistry fluid characterization with as little as one mL of fluid volume.

DETAILED DESCRIPTION

While sample volume requirements have been reduced over time, the characterization of a reservoir has become more complex. This gives rise to the need for obtaining a growing number of samples, which stands in opposition to the expense of redesigning down hole sampling tools to obtain an optimal number of samples for a given sample container volume.

To address this challenge, among others, the inventors have discovered a way to augment existing sampling capability with a variable size sample container—so that existing tool modules can be retrofitted, instead of being redesigned. In many embodiments, existing sample chambers can be divided into sub-compartments, so that conventional down hole sampling tools (e.g., a multi-chamber sampling (MCS) sub, such as the Halliburton® RDT® tool) may be fitted with a number of chambers that are sized for a particular fluid sampling job. Thus, many of the embodiments herein will be described in the context of an MCS sampling configuration. However, it should be noted that this is done for reasons of clarity and simplicity, and not of limitation. Other tool configurations may also be used.

Figure 3:
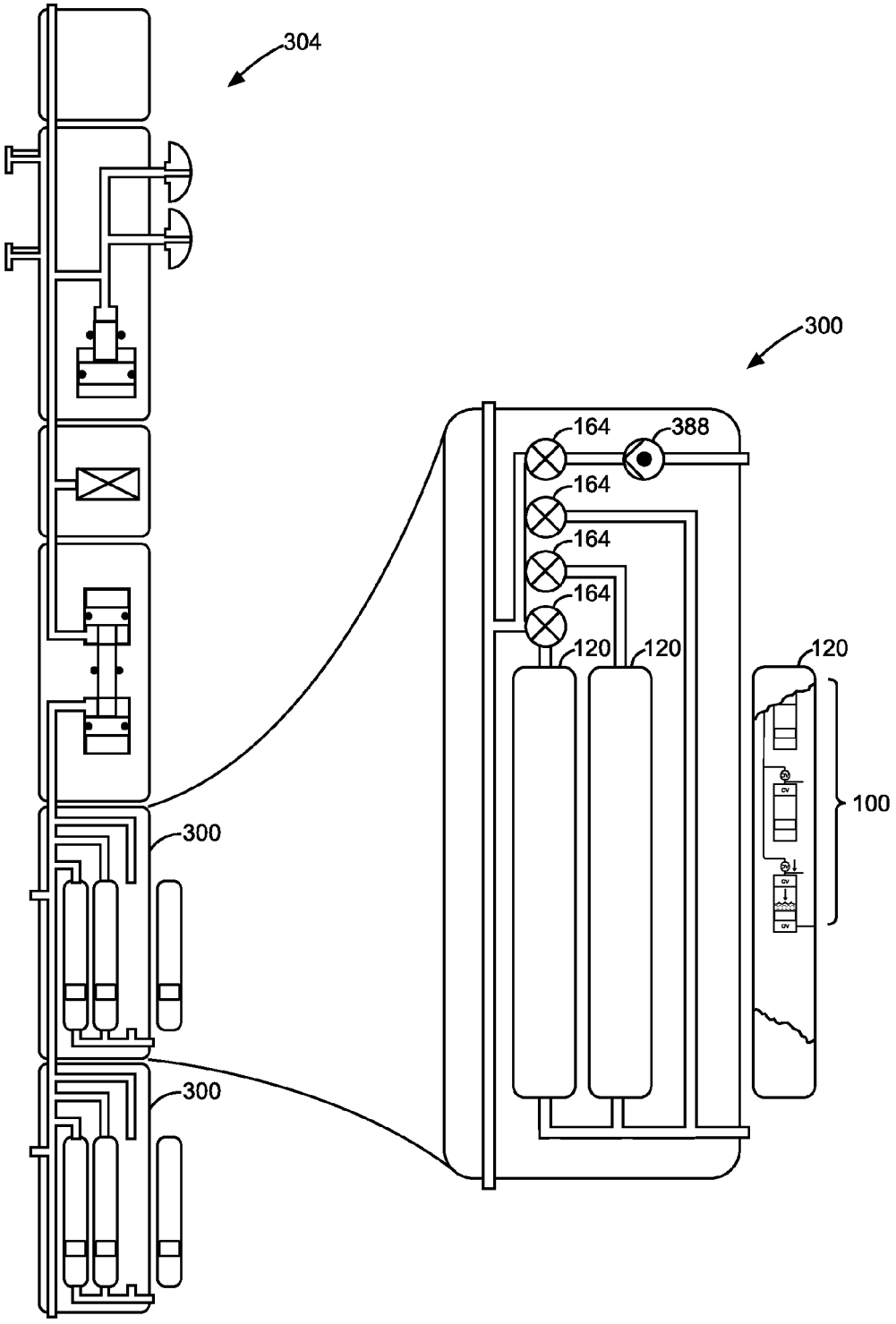
FIG. 3 illustrates a housing, comprising a down hole tool, that includes multiple versions of sampling chamber apparatus according to various embodiments of the invention.

In some embodiments, an MCS tool holds three 1000 mL sampling modules (e.g., see FIG. 3, illustrating a tool with two MCS subs 300, each including multiple modules 120). Each module can be inserted into the tool for exposure to mud (i.e., drilling fluid) column pressure. Within the tool section and separating the tool section from the sampling module is at least one actuated upon-command valve. This command-operated valve receives input from the surface to either open or close.

During the course of sampling activity, fluid is withdrawn from the formation and analyzed for quality. When fluid of a sufficient quality is obtained, the flow is diverted into one of the modules in the MCS tool. In conventional sampling assemblies, the module operates as a single sampling chamber that forms an empty void, or comprises a piston-backed space. This space is sometimes filled with a material of sufficient quality to achieve the sample preservation desired. For example, the space behind the piston may be filled with nitrogen for phase maintenance, or a liquid that is vented to the mud column during sampling "zero shock" operation (e.g., attempting to minimize opening shock). However, in many embodiments, these modules are modified to provide a housing for multiple sampling chambers configured as described in the paragraphs that follow.

Figure 1B:
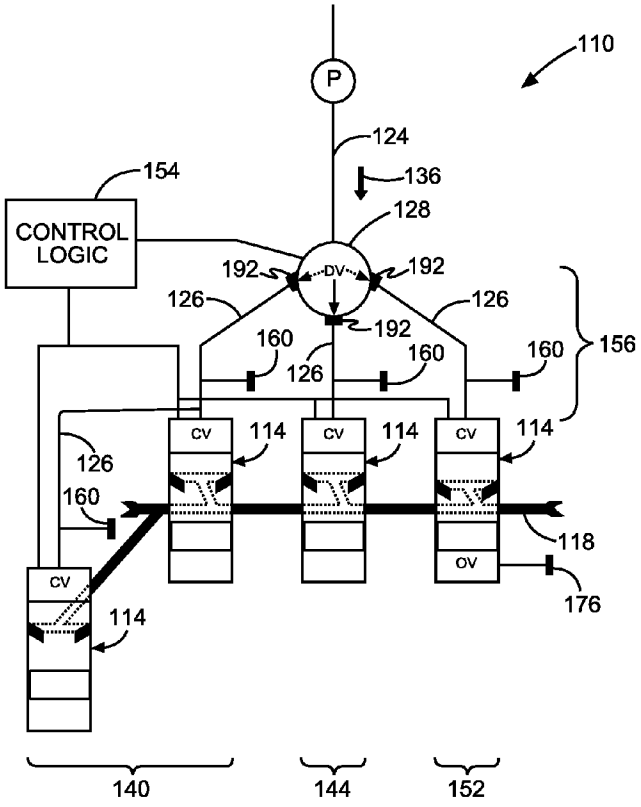
FIGS. 1A and 1B illustrate examples of sampling chamber apparatus according to various embodiments of the invention.
Figure 1A:
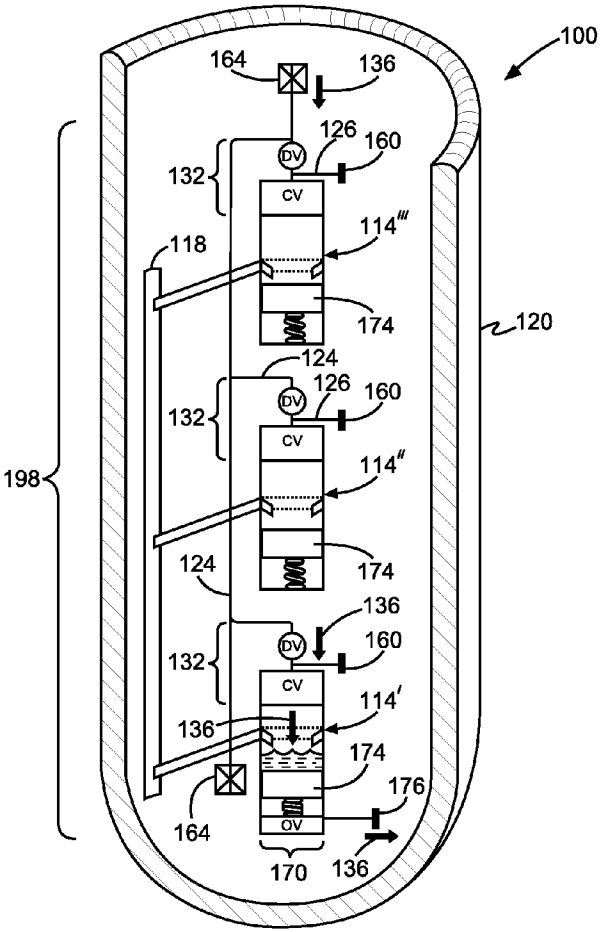

For example, FIGS. 1A and 1B illustrate examples of sampling chamber apparatus 100, 110 according to various embodiments of the invention. These apparatus 100, 110, comprising a set of fluid sampling chambers 114, can be sized to fit within a single module 120 of the MCS tool. In some embodiments, the apparatus 100, 110 are used as a direct replacement for the module 120, itself. In this case, the apparatus 100, 110 may be attached to a chassis 118 to hold the individual fluid sampling chambers 114 in place within the tool or MCS sub.

Thus, the modules 120 can be retrofitted to hold the apparatus 100, 110, or the modules 120 can be replaced entirely with a chassis 118 that holds smaller chambers 114 of a desired size. In this case, each chamber 114 is connected to the chassis 118, and the chassis 118 contains a pressure open shield from the formation. The purpose of the shield is to prevent damage during transit or trips.

The chassis 118 may be attached to one or more internal flow lines 124, 126 that can be used to couple various sampling chambers 114 together in a daisy chain arrangement (e.g., see FIG. 1A), or a common selection arrangement (e.g., see FIG. 1B). The flow lines 124 can also be used to couple the sampling chambers 114 to a central valve 128, such as a diversion valve DV. Combinations of daisy chain and common selection arrangements may also be employed.

In some embodiments (see FIG. 1A), at the head of each chamber 114 is a closure mechanism 132. In FIG. 1A, the mechanism 132 includes one check valve CV (e.g., a Schrader valve) associated with the chamber 114, and a directional valve DV associated with the flow line 124. Any of the valves CV, DV may operate using charged actuation. Thus, in some embodiments, the mechanism 132 comprises a mechanically actuated, bi-stable switch (e.g., a charged state, J-slot valve) in combination with a check valve CV.

For example, in the apparatus 110, a directional valve DV may be operated as a charged valve that is preset to direct fluid flow 136 to a specific chamber 114, or series of chambers, such as the first chamber series 140. Upon activation, the stored energy in the valve 128 moves the valve 128 to direct the fluid flow 136 to a second chamber series 144, which is shown in the figure to have only one sampling chamber 114, but any number of chambers 114 can be used.

Activation/switching of the valve 128 can be accomplished using a negative fluid pressure pulse (with respect to the pressure of the mud column). Activation may also be accomplished using a positive fluid pressure pulse—one that exceeds a preset threshold. In some embodiments, activation occurs when the valve 128 receives an electrical pulse.

For example, when the valve 128 operates to direct the fluid flow 136 provided by a pump P to the first chamber series 140, the positive pressure in the flow line 124 forces the check valves CV for the series 140 to open—and the chambers 114 in the series 140 proceed to fill with fluid. Once filled, the pump P can be made reverses direction, causing a negative pressure pulse in the flow line 126 for the series 140, closing the associated check valves CV. At about the same time, the directional valve 128 routes the fluid flow 136 away from the first chamber series 140, and toward the next available chamber 114, which is the second chamber series 144.

An alternative chamber switching mechanism involves the use of a positive pressure pulse (with respect to the mud column pressure) to actuate the directional valve 128 to redirect the flow 136 from the first series 140 to the second series 144 of chambers 114.

In some embodiments, the energy for activating one or more valves is taken from the positive pulse itself. An advantage of this configuration might be enabling reversible, incremental state selection, so that the flow 136 can be repeatedly cycled between a first, second, and third series 140, 144, 152 of chambers 114.

Electrical pulses can also be used to repeatedly actuate the directional valve 128, to cause a cycling of the flow 136 between the series 140, 144, 152. In this case, the activation pulse may enable using stored energy to switch the valve 128 between first, second and third states. The activation pulse itself may also be used to supply the energy required to reversibly enter alternate states.

Each flow line 124, 126 leading to, and coupled between the sampling chambers 114 may contain one or more check valves CV to release pressure. This may permit the use of lower pressure materials when flow lines 124 are fabricated. For example, the differential pressure between the mud column and the flow line 124 may be less than 30 MPa. Therefore the flow line itself may be rated well below chamber pressure as long as the ability to vent excess pressure exists. Thus, if the flow line is rated for 40 MPa, a check valve CV could be used to prevent exposing the flow line 124 to more than a 30 MPa differential pressure. This enables the use of relatively low pressure flow line 124 to couple the chambers 114 together, making the results apparatus easier to configure. As a matter of contrast, if the flow line 124 were fully rated at 130 MPa, the construction might involve machining into a hard body—such that every installation would constitute a custom configuration.

In some embodiments, during sampling operations, a trapped volume 156 of fluid will exist between the check valve CV and the directional valve DV that form part of a closure mechanism 132. The fluid held in the trapped volume 156 is contained within a sampling segment of the segregated flow line 126 defined at its ends by the valves CV, DV, and may be used as a live micro-sample. A tap port 160 may be used to access the trapped volume 156 in the segregated flow line 126, and may be attached to the segregated flow line 126, or built into one of the valves CV, DV. Simple analytics, such as gas/oil ratio (GOR) and composition may be performed on the trapped fluid micro-sample. The port 160 may include an inlet fitted directly for analytical probe reception.

In some embodiments, a pre-charged daisy chain configuration of chambers 114 allows a string of smaller samples, perhaps with a sample volume of less than one mL, to be obtained. The apparatus 100 may fit into an existing MCS module 120 with top and bottom valves 164. Packed into the module 120 might be a series of sampling chambers 114, each open to the flow 136 within the module 120. A pressure pulse (positive or negative) or electrical pulse as described previously could be used to activate valves DV, CV coupled to one or more of the sampling chambers 114. For example, in some embodiments, the activation of a prior chamber 114' in a series 170 of chambers 114 might enable the activation of the next chamber 114" in the series 170 of chambers 114. A pressure pulse or electrical pulse could then be used to actuate the next chamber 114", which results in arming a further chamber 114'" in the series 170, and so on. Chambers 114 can be activated in a numerical sequence, such as first, second, third, which may designate a linear order, or other orders of activation within the sequence. The series 170 of chambers 114', 114", 114'" can also be filled in parallel, for reliability redundancy, and to generate sampling statistics.

One or more of the sampling chambers 114 may be fitted with an outlet valve OV to regulate back pressure. The outlet valve OV may comprise a check valve or some other valve type which provides an outlet 176 that can be used to flush fluid 136 from the interior of the chamber 114.

In some embodiments of the chambers 114, the operation of an inlet valve (e.g., a check valve CV) and an outlet valve OV join with that of a piston 174. As fluid flow 136 enters the inlet valve (e.g., check valve CV), the fluid displaces the piston 174 until the pressure within the sampling chamber 114 rises to exceed the differential pressure between the mud column and the backing pressure of the valve.

The inlet valve may be connected to an internal tubular that forces flushing of its associated chamber 114, or the outlet valve OV may be connected to an internal tubular that forces flushing of its associated chamber 114. When the associated directional valve DV is deactivated, and the associated inlet valve shuts off, a similar deactivation of the outlet valve OV can be used to shut off the flow at the outlet 176 of the chamber 114. In some embodiments, the inlet and/or outlet valves may be charged in a normally open state, so as to close upon activation. The same mechanism used to shut the inlet valve may also be used to shut the outlet valve OV, which can be most easily accomplished when the two valves are co-located or built into the same device.

The outlet valve OV can be actuated to set the pressure within the sampling chamber 114. The fluid flow 136 from the outlet valve OV can be directed to the mud column, or back into the tool for further analysis. The trigger set points (e.g., pressures) for the various valves in any given version of the apparatus 100, 110 may be different to achieve some desired autonomous sequence of events. The triggering mechanisms for any number of valves within a series of valves, or within a single version of the apparatus 100, 110 may also be different. Each of the valves may be replicated for redundant flow, and the actuation mechanisms may likewise be redundant, so that a failure of electrical or fluid pressure activation does not prevent operation of the apparatus 100, 110.

Figure 2A:
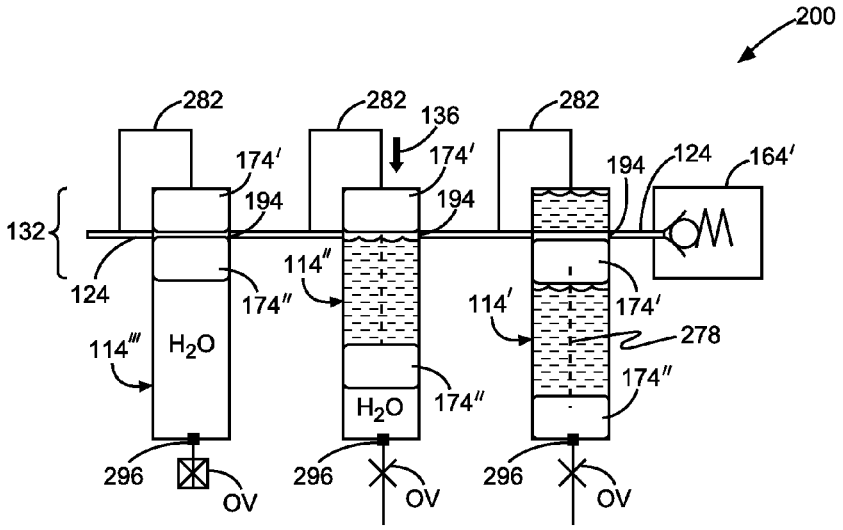
FIGS. 2A and 2B illustrate additional examples of sampling chamber apparatus according to various embodiments of the invention.
Figure 2B:
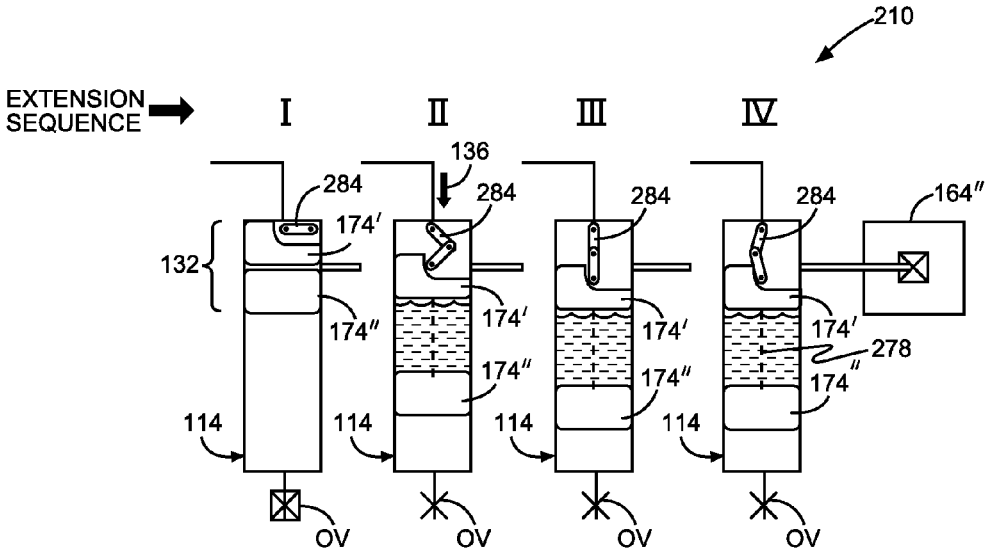

FIGS. 2A and 2B illustrate additional examples of sampling chamber apparatus 200, 210 according to various embodiments of the invention. In the apparatus 200, the design of the chambers is based on a pair of sample containment pistons 174 that are coupled together. The coupling mechanism 278 may comprise a rod or chain, among others.

Referring now to FIG. 2A, it can be seen that there are three chambers 114', 114", 114'". Chamber 114' is completely filled, chamber 114" is in the process of being filled, and chamber 114'" has not yet started to be filled. It is assumed that the pressure in the flow line 124 is higher than hydrostatic. Entry of fluid flow into the series of chambers 114 may be controlled by a valve 164, such as a stiffly sprung check valve 164' or an actuated valve 164" (e.g., see the actuated valve 164" in FIG. 2B).

To fill any one of the chambers 114, in sequence, after the module valve 164 is opened to permit the occurrence of fluid flow 136, an outlet valve OV can be opened to permit the fluid flow 136 to enter a chamber 114, separating the pistons 174. Water ($H_2O$) or some other fluid might be used as a backing for one of the pistons 174, to prevent initial separation of the pistons 174, due to the closed outlet valve OV.

When the outlet valve OV at the bottom of a chamber 114 is opened, the lower piston 174" is driven until the slack in the coupling mechanism 278 is taken up by tension. At that point, each of the pistons 174', 174" in the pair are driven to move. Once the upper piston 174' is driven past the fluid flow line 124, the bypass 282 provides flow to the top of the upper piston 174' until the lower piston 174" in the pair hits the end of the length of the coupling mechanism 278. The pressure within the chamber 114 continues to increase, driving the pair of pistons 174 lower in the chamber 114, until the upper piston 174' clears the flow line 124, shutting off sampling for its associated chamber 114. Once the prior chamber 114' in the series is filled, the outlet valve OV for the next chamber 114" in the series may be opened, and sampling of the fluid flow 136 may commence for the next chamber 114".

Referring now to FIG. 2B, it can be seen that in some embodiments, the strength of the coupling mechanism 278 can be reduced if the upper piston 174' is fitted with a locking column 284. The locking column 284 may comprise a series of links, similar to the drive chain on a bicycle or motorcycle. As the chamber 114 fills in this example embodiment, it can be seen that the column 284 comprises three joints, and deploys from a rest position (see part I of the extension sequence) by extending, reaching full extension, and then hyper-extending (see parts II, II, and IV in the extension sequence), where the column is locked by the action of an indented upper piston 174'. A spring-loaded collar can also be used to lock the column 284 upon extension (e.g., see part III in the extension sequence). A combination of pressure and gravity may be used to release the upper piston 174' when desired.

FIG. 3 illustrates a housing 304, comprising a down hole tool, that includes multiple versions of sampling chamber apparatus 100 according to various embodiments of the invention. While apparatus 100 is explicitly shown in FIG. 3, it should be understood that any one of the apparatus 100, 110, 200, 210, and combinations of these, can be disposed within the modules 120. Moreover, as noted previously, while the apparatus 100 is shown disposed within the module 120, in some embodiments, the apparatus 100 (as well as apparatus 110, 200, 210) is used to completely displace the module 120.

As seen in FIG. 3, a wide variety of sampling configurations may be used within a single MCS sub 300. A command-operated valve 388 allows fluid flow 136 to enter the sub 300 and pass on to the modules 120. Entry into each module 120 may also be controlled by one or more valves 164.

Using the mechanism disclosed herein, the volume available for sampling within the sub 300 can be divided up in many ways, without having to redesign the configuration of the housing 304, and possibly without changing the interior configuration of the sub 300. For example, at the highest level, one or more of the apparatus 100, 100, 200, 210 may be placed directly within the sub 300. Chamber 114 volumes may be intermixed, with some chambers 114 having a sampling volume as large as 1000 mL, or larger. On the other hand, some chamber sampling volumes may be less than 1000 mL, such as 500 mL or 250 mL, or 100 mL.

In some embodiments, one or more series of the chambers 114 will be installed within the sub 300. In some embodiments, one or more series of the chambers 114 will be installed inside of interchangeable modules 120, which are in turn installed in the sub 300. In this way, samples of fluid acquired down hole can be easily separated from the sub 300 by removing any desired module 120 from the sub 300.

Many arrangements of modules 120 and chambers 114 may be realized. For example, if the purpose of sampling is to characterize the compositional gradation within a reservoir, a large number of 50 mL sample chambers 114 may be disposed within several 500 mL modules 120, which are in turn disposed within an MCS sub 300. If the purpose of sampling is to understand the behavior of a critical phase condensate and contamination is to be accurately determined, then a 200 mL/800 mL combination of chambers 114 may be used, with the 200 mL chamber 114 used to obtain "pure drilling fluid filtrate" sampled early in a pump out cycle, and the 800 mL chamber 114 used to obtain the filtrate in a cleaner condition, later in the pump out cycle.

Although the packing efficiency of multiple chambers 114 within a sub 300 or a module 120 will be less than the ideal of 100% (i.e., a 1000 mL module volume will not accommodate a series of chambers 114 having a combined sampling volume of 1000 mL), many configuration options will be available. The general concept is not limited to any given chamber size limit, with some embodiments making use of chambers 114 that have less than one mL of sampling volume capability. Interstitial spaces may be used for plumbing, electrical wiring, and chassis support structures. Thus, referring now to FIGS. 1-3, it can be seen that many embodiments may be realized.

For example, in some embodiments, an apparatus 100, 110, 200, 210 may comprise a set of chambers 114 and corresponding closure mechanisms 132 that comprise check valves CV and one or more diversion valves DV that cooperate to sample fluid in a selected sequence. As used herein, the term "check valve" refers to a valve that permits or stops fluid flow to a single destination. As used herein, the term "diversion valve" refers to a valve that permits or stops fluid flow to more than one destination.

In some embodiments, the apparatus 100, 110, 200, 210 comprises a set of fluid sampling chambers 114 sharing a common inflow sampling line 124, and a set of closure mechanisms 132 having a one-to-one correspondence with the fluid sampling chambers 114. The fluid sampling chambers 114 may be configured to sample fluid in the sampling line 124 in a selected sequence, such that filling a prior fluid sampling chamber 114' in the selected sequence enables sampling in a next fluid sampling chamber 114" in the selected sequence. The closure mechanisms 132 may comprise individual check valves CVs and a common diversion valve DV or individual diversion valves DVs.

In some embodiments, the closure mechanisms may include pairs of sample containment pistons. Thus, at least some of the closure mechanisms 132 may comprise at least one piston 174 in a pair of sample containment pistons 174 disposed within a respective one of the chambers 114.

In some embodiments, the diversion valve may operate in an incremental fashion, driven by pressure pulses. Thus, the selected sequence of sampling may be predetermined according to a coupling arrangement between the common diversion valve DV and the individual check valves CVs. The common diversion valve DV may comprise a pressure-activated diversion mechanism to incrementally select diversion outlets 192 coupled to the fluid sampling chambers 114.

Thus, hydraulic sensing and control built into the valves can be used to enable autonomous operation of the apparatus 100, 110, 200, 210. Electrical control, using the control logic 154 of FIG. 1B may likewise be used. Combinations of hydraulic and electric control are also possible, as will be realized by those of ordinary skill in the art, after reading this detailed description and studying the attached figures.

In some embodiments, a series of links can be coupled to one or more pistons to close the chambers, to terminate sampling within the chambers. Thus, at least some of the closure mechanisms 132 comprise a piston 174 and a set of serially-coupled links (e.g., the column 284) that are flexible to a greater degree in a first direction (e.g., extension) than in a second direction (e.g., hyperextension), so as to be lockable against pressure when moved in the second direction by the piston 174.

In some embodiments, pistons in the chambers may be designed to interact with the links to lock the links in place when sampling is complete. Thus, one or more of the pistons 174 in some chambers 114 may comprise an indented piston to limit travel of the serially-coupled links in the second direction (e.g., see piston 174' in extension sequence IV of FIG. 2B).

In some embodiments, flow lines leading to the sampling chambers can serve as micro-sampling chambers themselves, trapping smaller fluid samples that can be accessed by individual, selectable taps. Thus, the apparatus 100, 110, 200, 210 may comprise sampling segments (e.g., segregated portions of the flow line 126 containing the trapped volume 156) fluidly coupled between the common diversion valve DV or the individual diversion valves DVs, and individual check valves CVs, with a set of taps 160 having a one-to-one correspondence to the sampling segments to permit individual access to fluid stored in the sampling segments.

In some embodiments, pressure pulses or electrical signals, or both, can be used to sequence sampling operations. Thus, the set of closure mechanisms 132 may be configured to be opened and closed using one of pressure pulses or electrical signals. Opening or closing may be used to expose an inner portion of the sampling chambers 114 to the common flow line 124 to receive fluid present in the common flow line 124 according to the selected sampling sequence.

In some embodiments, the common diversion valve may comprise a series of pistons operating at one end of the sampling chambers. Thus, the common diversion valve DV may be formed by a combination of first pistons 174' having a one-to-one correspondence with the fluid sampling chambers 114, with the first pistons 174' being disposed proximate to sampling fluid inlets 194 in the fluid sampling chambers 114.

In some embodiments, check valves may be disposed at the opposite end of the sampling chambers from the diversion valve pistons. Thus, individual check valves (e.g., the outlet valves OV) may be disposed proximate to second pistons 174" having a one-to-one correspondence with the fluid sampling chambers 114, with the second pistons 174" disposed proximate to fluid outlets 296 in the fluid sampling chambers.

In some embodiments, individual diversion valves may be used to selectively direct fluid to sampling lines that couple to individual check valves, and corresponding individual sampling chambers. Thus, individual diversion valves DVs may be configured to enable selectively coupling a corresponding plurality of fluid passages (e.g., segregated flow lines 126) from one or more sets of fluid sampling chambers 114 to the common inflow sampling line 124.

Piston pairs within the chambers may comprise mutually-coupled, sample containment pistons. Thus, one or more of the fluid sampling chambers 114 may comprise a pair of mutually-coupled sampling containment pistons 174, wherein the coupling mechanism 278 between each pair of pistons 174 serves to define a fixed volume of fluid to be received between that pair of pistons 174.

As mentioned previously, an MCS sub or MCS sub modules may be retrofitted to accommodate one or more of the apparatus 100, 110, 200, 210. Retrofit kits can be used to accomplish this task. Once samples are obtained, retrofitted modules 120, each holding a plurality of sampling chambers 114, can be shipped directly to a laboratory with the individual samples intact. This obviates the need for a well site sample transfer, which risks leakage, spills, spray, and sample corruption. Thus, a kit of parts can be assembled to retrofit an MCS sub, or sampling modules 120 that are used within the sub.

For example, a kit of parts 198 to retrofit an MCS sub 300 having a set of sampling modules 120 may comprise a set of fluid sampling chambers 114 configured to share a common inflow sampling line 124, wherein multiple ones of the fluid sampling chambers 114 are sized to fit into at least one of the sampling modules 120. The kit 198 may further include a set of closure mechanisms 132 having a one-to-one correspondence with the fluid sampling chambers 114. The chambers 114 in the kit 198 are configured to sample fluid in the sampling line 124 in a selected sequence, such that filling a prior fluid sampling chamber in the selected sequence enables sampling in a next fluid sampling chamber in the selected sequence. The closure mechanisms 132 in many embodiments comprise individual check valves CVs and a common diversion valve DV or individual diversion valves DVs.

The fluid sampling chambers may include pairs of pistons. Thus, the kit 198 may comprise pairs of pistons 174 to be disposed within at least some of the chambers 114, the pairs of pistons 174 each comprising individual pistons 174 mechanically coupled to each other by a coupling mechanism 278 having a fixed length.

The fluid sampling chambers may be coupled to individual, tapped flow lines to capture micro-samples. Thus, the kit 198 may comprise a set of segregated flow lines 126 to couple to at least some of the fluid sampling chambers 114, each of the flow lines 126 comprising a sampling tap 160 to enable individual access to a sample of the fluid trapped in a respective one of the flow lines 126. Any number of additional embodiments may be realized.

Figure 4:
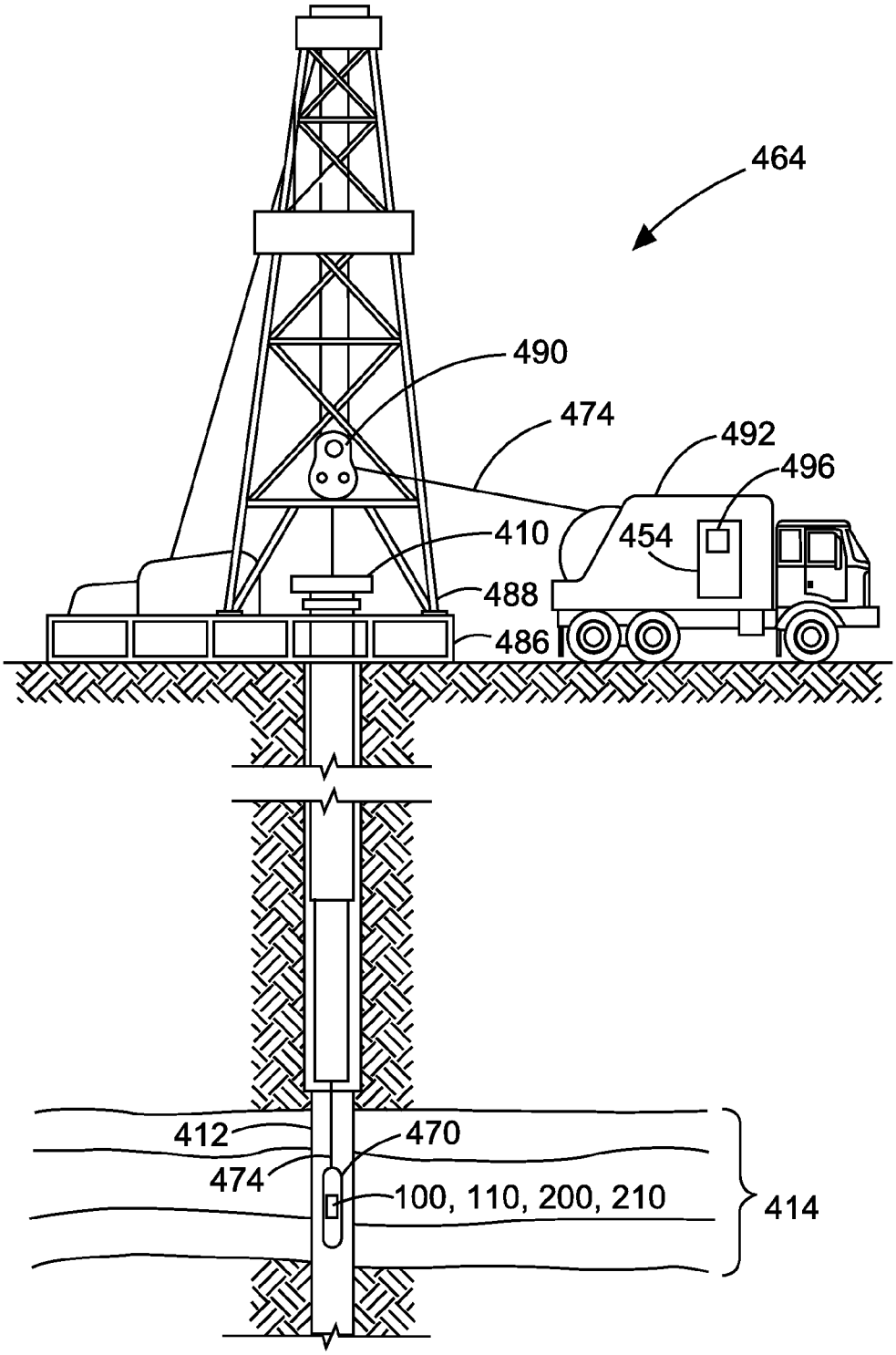
FIG. 4 illustrates a wireline system embodiment of the invention.
Figure 5:
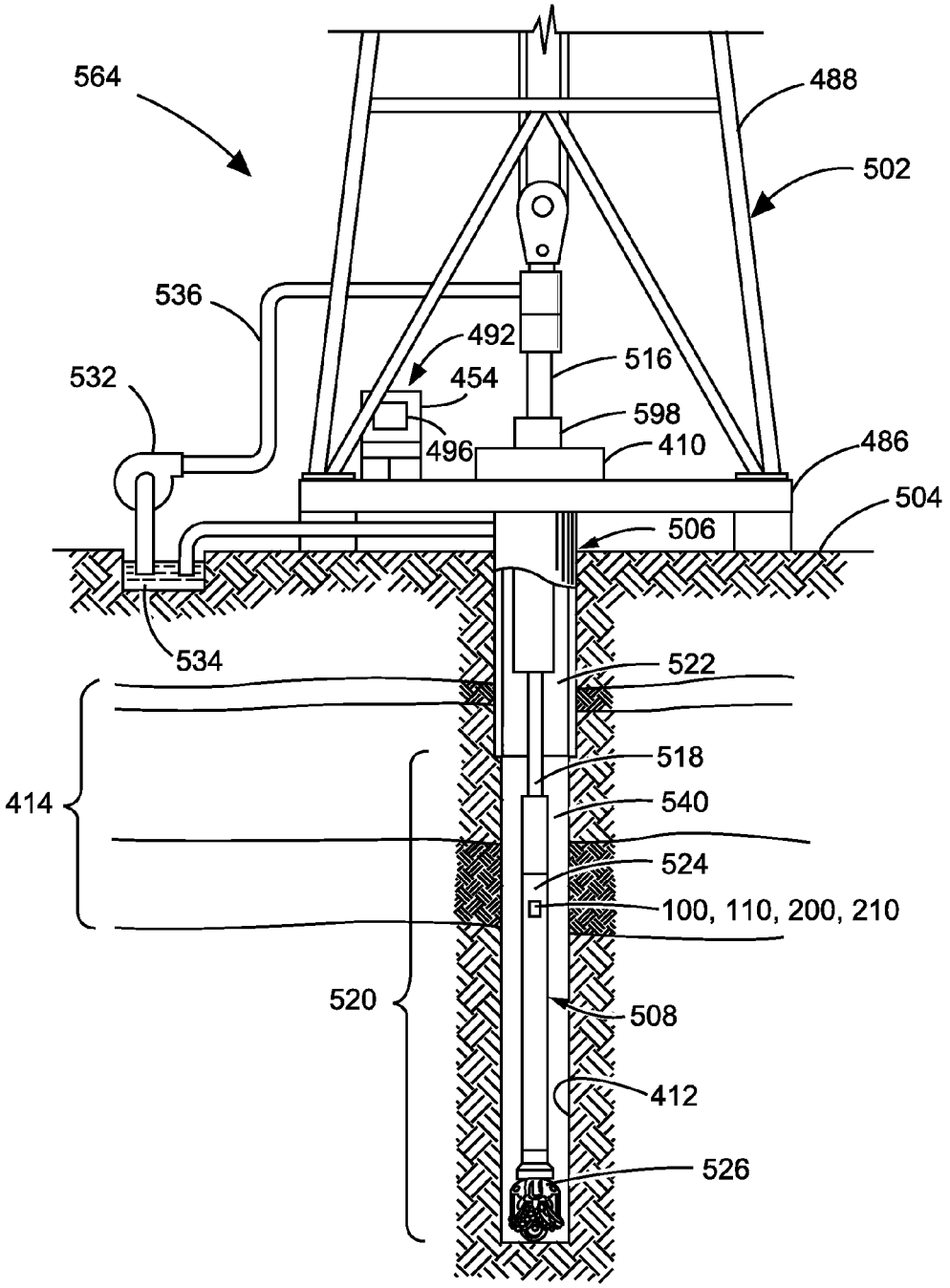
FIG. 5 illustrates a while-drilling system embodiment of the invention.

For example, FIG. 4 illustrates a wireline system 464 embodiment of the invention, and FIG. 5 illustrates a while-drilling system 564 embodiment of the invention. Thus, the systems 464, 564 may comprise portions of a tool body 470 as part of a wireline logging operation, or of a down hole tool 524 as part of a down hole drilling operation.

FIG. 4 shows a well during wireline logging operations. A drilling platform 486 is equipped with a derrick 488 that supports a hoist 490.

The drilling of oil and gas wells is commonly carried out using a string of drill pipes connected together so as to form a drilling string that is lowered through a rotary table 410 into a wellbore or borehole 412. Here it is assumed that the drill string has been temporarily removed from the borehole 412 to allow a wireline logging tool body 470, such as a probe or sonde, to be lowered by wireline or logging cable 474 into the borehole 412. Typically, the tool body 470 is lowered to the bottom of the region of interest and subsequently pulled upward at a substantially constant speed.

During the upward trip, at a series of depths the tool movement can be paused and the tool operated to pump fluids into the apparatus 100, 110, 200, 210 included in the tool body 470. Various instruments (e.g., sensors) may be used to perform measurements on the subsurface geological formations 414 adjacent the borehole 412 (and the tool body 470). The measurement data may be stored and/or processed down hole or communicated to a surface logging facility 492 for storage, processing, and analysis. The logging facility 492 may be provided with electronic equipment for various types of signal processing. Similar formation evaluation data may be gathered and analyzed during drilling operations (e.g., during logging while drilling (LWD) operations, and by extension, sampling while drilling).

In some embodiments, the tool body 470 comprises a formation testing tool for obtaining and analyzing a fluid sample from a subterranean formation through a wellbore. The formation testing tool is suspended in the wellbore by a wireline cable 474 that connects the tool to a surface control unit (e.g., comprising a computer workstation 454 or the like). The formation testing tool may be deployed in the wellbore on coiled tubing, jointed drill pipe, hard-wired drill pipe, or via any other suitable deployment technique.

Turning now to FIG. 5, it can be seen how a system 564 may also form a portion of a drilling rig 502 located at the surface 504 of a well 506. The drilling rig 502 may provide support for a drill string 508. The drill string 508 may operate to penetrate a rotary table 410 for drilling a borehole 412 through subsurface formations 414. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create a borehole 412 by penetrating the surface 504 and subsurface formations 414. The down hole tool 524 may comprise any of a number of different types of tools including MWD (measurement while drilling) tools, LWD tools, and others.

During drilling operations, the drill string 508 (perhaps including the Kelly 516, the drill pipe 518, and the bottom hole assembly 520) may be rotated by the rotary table 410. In addition to, or alternatively, the bottom hole assembly 520 may also be rotated by a motor (e.g., a mud motor) that is located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 414.

During drilling operations, a mud pump 532 may pump drilling fluid (sometimes known by those of skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 412. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation cuttings created by operating the drill bit 526.

Thus, referring now to FIGS. 1-5, it may be seen that in some embodiments, a system 464, 564 may include a housing 304, such as a down hole tool 524, and/or a wireline logging tool body 470 to house one or more apparatus and/or systems, similar to or identical to the apparatus and systems described above and illustrated in FIGS. 1-3. Wireline tools are frequently adapted for use in a drill string when wireline conveyance is not possible. For example, this may be the case to accommodate highly deviated boreholes or horizontal wells. Thus, for the purposes of this document, the term "housing" may include any one or more of a down hole tool 524 or a wireline logging tool body 470 (each having an outer wall that can be used to enclose or attach to instrumentation, sensors, fluid sampling devices, such as probes, pressure measurement devices, such as sensors, seals, processors, and data acquisition systems). The down hole tool 524 may comprise an LWD tool or MWD tool. The tool body 470 may comprise a wireline logging tool, including a probe or sonde, for example, coupled to a logging cable 474. Many embodiments may thus be realized.

For example, in some embodiments a system 464, 564 may comprise a housing 304 and one or more sets of fluid sampling chambers 114 (e.g., a series of chambers 114) disposed within the housing 304 and sharing a common inflow sampling line 124. The system 464, 564 may further comprise a set of closure mechanisms 132 that operate as described previously. The housing 304 may comprise a wireline tool or an MCS sampling tool.

In some embodiments, a system 464, 564 may include a display 496 to present fluid sampling data, and other information, perhaps in graphic form. A system 464, 564 may also include computation logic, perhaps as part of a surface logging facility 492, or a computer workstation 454, to receive signals from fluid sampling devices (e.g., apparatus 100, 110, 200, 210) and other instrumentation to determine the status of down hole sampling operations. The workstation 454 can be used to adjust autonomous operation, or to completely control operations of the apparatus 100, 110, 200, 210 if these are not configured to operate autonomously.

The apparatus 100, 110, 200, 210; sampling chambers 114; chassis 118; modules 120; flow lines 124, 126; valves 128, 164, 388; mechanism 132; fluid flow 136; chamber series 140, 144, 152, 170; trapped volume 156; ports 160; piston 174; outlets 176, 296; inlets 194; kit of parts 198; coupling mechanism 278; bypass 282; locking column 284;

MCS sub 300; housing 304; rotary table 410; workstation 454; tool body 470; drilling platform 486; derrick 488; hoist 490; logging facility 492; display 496; drilling rig 502; drill string 508; Kelly 516; drill pipe 518; bottom hole assembly 520; drill collars 522; down hole tool 524; drill bit 526; mud pump 532; hose 536; check valve CV; diversion valve DV; outlet valve OV; and pump P may all be characterized as "modules" herein.

Such modules may include hardware circuitry, a processor, memory circuits, software program modules and objects, firmware, and/or combinations thereof, as desired by the architect of the apparatus 100, 110, 200, 210 and systems 464, 564, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus 100, 110, 200, 210 and systems 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments may include electronic circuitry used in high-speed computers, communication and signal processing circuitry, modems, processor modules, embedded processors, data switches, application-specific modules, or combinations thereof. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
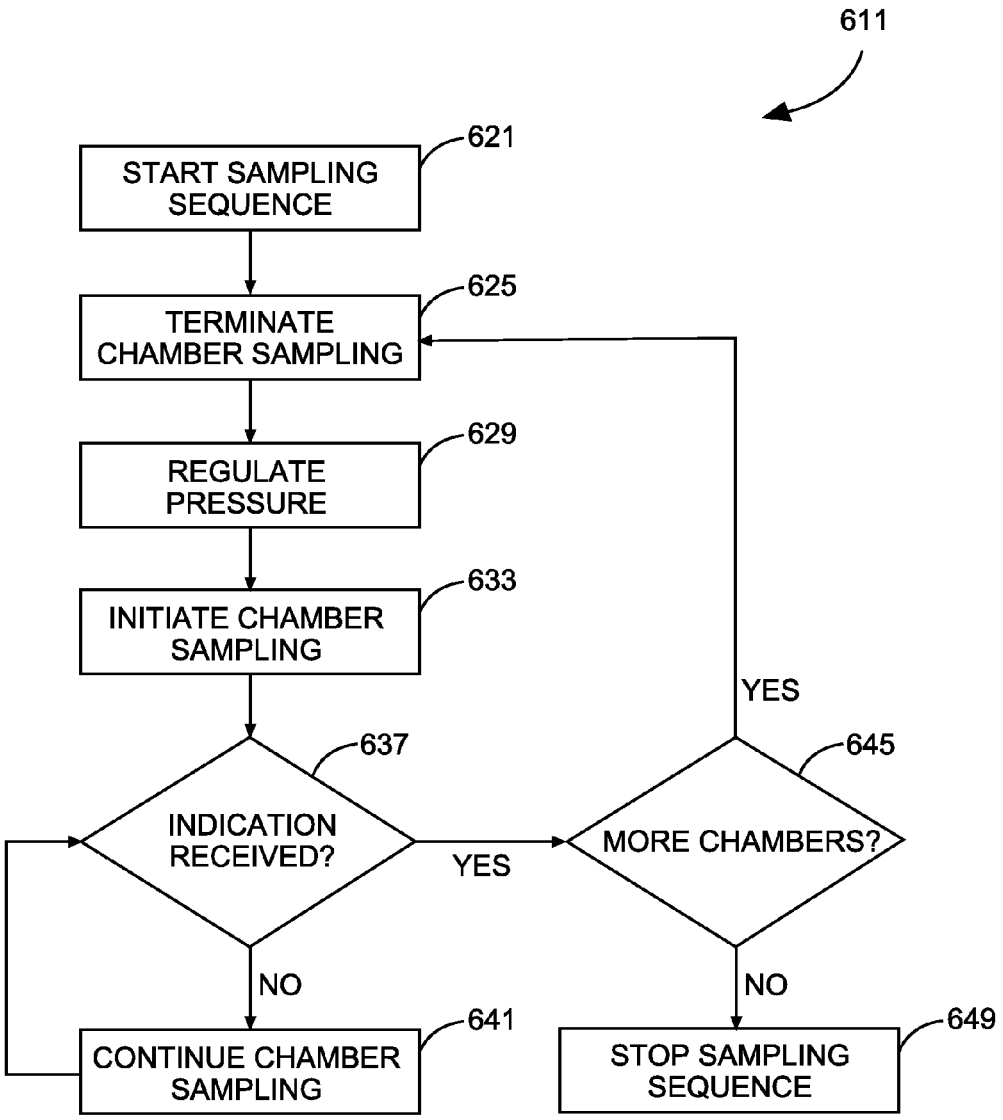
FIG. 6 is a flow chart illustrating several methods according to various embodiments of the invention.

For example, FIG. 6 is a flow chart illustrating several methods 611 of managing a sampling sequence when multiple sampling chambers share a common inflow sampling line. Thus, a processor-implemented method 611 to execute on one or more processors that perform the method (e.g., via the control logic 154 of FIG. 1B, and/or the workstation 454 of FIGS. 4, 5) may include terminating sampling of a prior sample in a sequence, and initiating sampling of the next sample in the sequence, as part of using a series of sampling chambers having a predefined sampling sequence and sharing a common inflow sampling line. Terminating sampling for a prior chamber in the sequence permits sampling to begin for the next chamber in the sequence.

In some embodiments, the method 611 begins at block 621 with starting a sampling sequence for a set of sampling chambers that includes at least one prior chamber, and at least one next chamber that follows the prior chamber in a preselected sampling sequence, to be used for sampling fluid according to the sequence, where the next chamber follows the prior chamber in the sequence. Once sampling is initiated, the method 611 may continue on to block 625 with terminating sampling of fluid into the prior one of the set of fluid sampling chambers sharing a common inflow sampling line by operating a set of closure mechanisms. The closure mechanisms may comprise individual check valves, and a common diversion valve or individual diversion valves.

Sampling line pressure may be reduced below hydrostatic pressure, so that smaller flow lines can be used, saving volume within the chamber containment vessel, perhaps comprising an MCS sub. Thus, the method 611 may comprise, at block 629, regulating a differential pressure between hydrostatic pressure and sampling pressure in flow lines coupled to the fluid sampling chambers so that a pressure imposed on the flow lines is less than the hydrostatic pressure.

The method 611 may continue on to block 633 to include initiating sampling of the fluid into a next one of the set of fluid sampling chambers, wherein the fluid sampling chambers are configured to sample the fluid in the sampling line in a selected sequence, such that filling the prior fluid sampling chamber as part of the sequence enables sampling in a next fluid sampling chamber as part of the sequence.

Check valves may operate irreversibly. Thus, the activity at block 633 may comprise operating the check valves as charged, irreversible valves.

Pressure pulses can be used to start, and/or finish, sampling for a particular chamber in the sequence. Thus, the method 611 may include, at block 637, determining whether an indication that sampling should terminate, or be initiated, has been received. The activity at block 637 may thus include receiving a pressure pulse in the common inflow sampling line to terminate sampling in the prior fluid sampling chamber, or to initiate sampling in the next fluid sampling chamber. This type of arrangement is one of many way to enable autonomous operation.

If no indication is received at block 637, then the method 611 may continue sampling at block 641, and waiting for the indication at block 637. Otherwise, the method 611 may continue on to block 645, to determine whether additional chambers in the set are left to activate as part of the sampling sequence.

If more chambers in the sampling sequence are to be filled, then the method 611 may return to block 625 with terminating sampling with the current (now prior) chamber. Otherwise, the method 611 may continue on to block 649 with stopping the sampling sequence at block 649.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 100, 110, 200, 210 and systems 464, 564 may be implemented in a machine-accessible and readable medium that is operational over one or more networks. The networks may be wired, wireless, or a combination of wired and wireless. The apparatus 100, 110, 200, 210 and systems 464, 564 can be used to implement, among other things, the processing associated with the methods 611 of FIG. 6. Modules may comprise hardware, software, and firmware, or any combination of these. Thus, additional embodiments may be realized.

Figure 7:
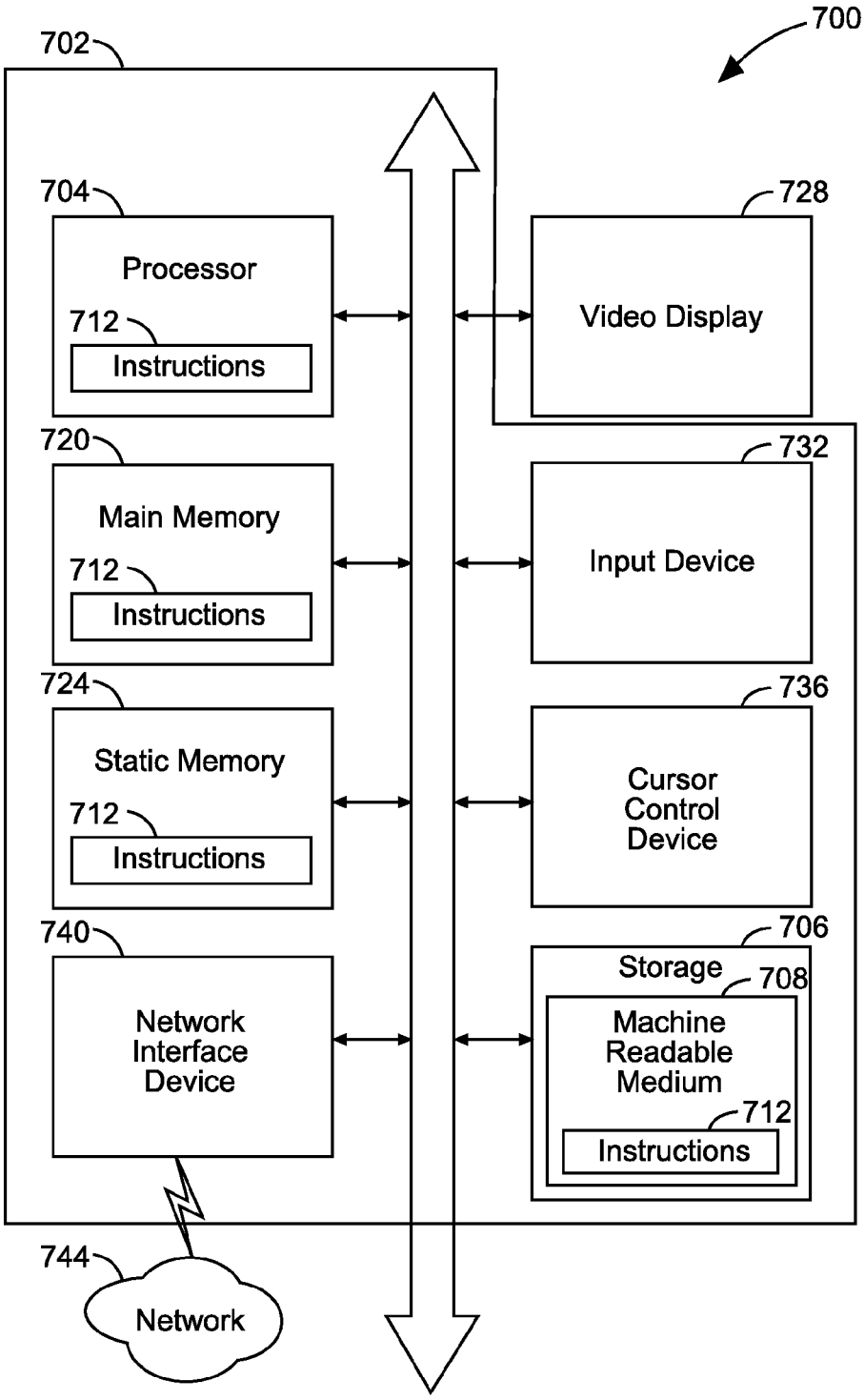
FIG. 7 is a block diagram of an article of manufacture, including a specific machine, according to various embodiments of the invention.

For example, FIG. 7 is a block diagram of an article 700 of manufacture, including a specific machine 702, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. For example, the programs may be structured in an object-orientated format using an object-oriented language such as Java or C++. In another example, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 700 of manufacture, such as a computer, a memory system, a magnetic or optical disk, some other storage device, and/or any type of electronic device or system may include one or more processors 704 coupled to a machine-readable medium 708 such as memory (e.g., removable storage media, as well as any memory including an electrical, optical, or electromagnetic conductor) having instructions 712 stored thereon (e.g., computer program instructions), which when executed by the one or more processors 704 result in the machine 702 performing any of the actions described with respect to the methods above.

The machine 702 may take the form of a specific computer system having a processor 704 coupled to a number of components directly, and/or using a bus 716. Thus, the machine 702 may be incorporated into the apparatus 100, 110, 200, 210 or system 464, 564 shown in FIGS. 1-5, perhaps as part of the control logic 154, and/or the workstation 454.

Turning now to FIG. 7, it can be seen that the components of the machine 702 may include main memory 720, static or non-volatile memory 724, and mass storage 706. Other components coupled to the processor 704 may include an input device 732, such as a keyboard, or a cursor control device 736, such as a mouse. An output device 728, such as a video display, may be located apart from the machine 702 (as shown), or made as an integral part of the machine 702.

A network interface device 740 to couple the processor 704 and other components to a network 744 may also be coupled to the bus 716. The instructions 712 may be transmitted or received over the network 744 via the network interface device 740 utilizing any one of a number of well-known transfer protocols (e.g., HyperText Transfer Protocol). Any of these elements coupled to the bus 716 may be absent, present singly, or present in plural numbers, depending on the specific embodiment to be realized.

The processor 704, the memories 720, 724, and the storage device 706 may each include instructions 712 which, when executed, cause the machine 702 to perform any one or more of the methods described herein. In some embodiments, the machine 702 operates as a standalone device or may be connected (e.g., networked) to other machines. In a networked environment, the machine 702 may operate in the capacity of a server or a client machine in server-client network environment, or as a peer machine in a peer-to-peer (or distributed) network environment.

The machine 702 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 702 is illustrated, the term "machine" shall also be taken to include any collection of machines that individually or jointly execute a set (or multiple sets) of instructions to perform any one or more of the methodologies discussed herein.

While the machine-readable medium 708 is shown as a single medium, the term "machine-readable medium" should be taken to include a single medium or multiple media (e.g., a centralized or distributed database, and/or associated caches and servers, and or a variety of storage media, such as the registers of the processor 704, memories 720, 724, and the storage device 706 that store the one or more sets of instructions 712. The term "machine-readable medium" shall also be taken to include any medium that is capable of storing, encoding or carrying a set of instructions for execution by the machine and that cause the machine 702 to perform any one or more of the methodologies of the present invention, or that is capable of storing, encoding or carrying data structures utilized by or associated with such a set of instructions. The terms "machine-readable medium" or "computer-readable medium" shall accordingly be taken to include non-transitory, tangible media, such as solid-state memories and optical and magnetic media.

Various embodiments may be implemented as a stand-alone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may give formation evaluation clients the opportunity to more efficiently obtain subsurface fluid samples, with a multitude of sampling chamber configurations that are easily tailored to a particular field job. Increased client satisfaction may result.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a multi-chamber sampling tool which allows fluid flow to a sampling module in the multi-chamber sampling tool;

the sampling module comprising a set of fluid sampling chambers with a total volume of the set being less than a volume of the sampling module and a common inflow sampling line, the set of fluid sampling chambers sharing the common inflow sampling line, wherein the common inflow sampling line is coupled to top and bottom valves of the sampling module which controls the fluid flow into the common inflow sampling line, wherein the sampling module is removable from the multi-chamber sampling tool; and a set of closure mechanisms having a one-to-one correspondence with the fluid sampling chambers, wherein the fluid sampling chambers are configured to sample fluid in the sampling line in a selected sequence, such that filling a first fluid sampling chamber in the selected sequence enables sampling in a second fluid sampling chamber in the selected sequence, and wherein the closure mechanisms comprise at least one of individual check valves, outlet valves, and a common diversion valve or individual diversion valves;

wherein the common inflow sampling line is arranged longitudinally in the sampling module; wherein the common inflow sampling line comprises first input and second input for receiving the fluid flow entering the sampling module at the top and bottom valves, respectively; wherein the first input is located at a position furthest away from the second input along the common inflow sampling line.

2. The apparatus of claim 1, wherein at least some of the closure mechanisms comprise at least one piston in a pair of sample containment pistons disposed within a respective one of the chambers.

3. The apparatus of claim 1, wherein the selected sequence is predetermined according to a coupling arrangement between the common diversion valve and the individual check valves, and wherein the common diversion valve comprises a pressure activated diversion mechanism to incrementally select diversion outlets coupled to the fluid sampling chambers.

4. The apparatus of claim 1, wherein at least some of the closure mechanisms comprise a piston and a set of serially-coupled links flexible to a greater degree in a first direction than in a second direction, so as to be lockable against pressure when moved in the second direction by the piston.

5. The apparatus of claim 4, wherein the piston comprises an indented piston to limit travel of the serially-coupled links in the second direction.

6. The apparatus of claim 1, further comprising:

sampling segments fluidly coupled between the common diversion valve or the individual diversion valves, and the individual check valves; and a set of taps having a one-to-one correspondence to the sampling segments to permit individual access to fluid stored in the sampling segments.

7. The apparatus of claim 1, wherein at least some of the set of closure mechanisms are configured to be opened and closed using one of pressure pulses or electrical signals to expose an inner portion of the sampling chambers to the common flow line to receive fluid present in the common flow line according to the selected sequence.

8. The apparatus of claim 1, wherein the common diversion valve is formed by a combination of first pistons having a one-to-one correspondence with the fluid sampling chambers, and wherein the first pistons are disposed proximate to sampling fluid inlets in the fluid sampling chambers.

9. The apparatus of claim 8, wherein the individual check valves are disposed proximate to second pistons having a one-to-one correspondence with the fluid sampling chambers, and wherein the second pistons are disposed proximate to fluid outlets in the fluid sampling chambers.

10. The apparatus of claim 1, wherein one or more of the fluid sampling chambers and internal flow lines associated with the common inflow sampling line are attached to a chassis in the sampling module, wherein the chassis is attached to the sampling module.

11. The apparatus of claim 1, wherein each of the fluid sampling chambers in the sampling module have different volumes.

12. A system, comprising:

a housing which allows fluid flow to a sampling module in the multi-chamber sampling tool;

the sampling module comprising a set of fluid sampling chambers with a total volume of the set being less than a volume of the sampling module and a common inflow sampling line, the set of fluid sampling chambers disposed within the housing and sharing the common inflow sampling line, wherein the common inflow sampling line is coupled to top and bottom valves which controls fluid flow into the common inflow sampling line, wherein the sampling module is removable from the housing; and a set of closure mechanisms having a one-to-one correspondence with the fluid sampling chambers, wherein the fluid sampling chambers are configured to sample fluid in the sampling line in a selected sequence, such that filling a first fluid sampling chamber in the sequence enables sampling in a second fluid sampling chamber in the selected sequence, and wherein the closure mechanisms comprise at least one of individual check valves, outlet valves, and a common diversion valve or individual diversion valves;

wherein the common inflow sampling line is arranged longitudinally in the sampling module; wherein the common inflow sampling line comprises first input and second input for receiving the fluid flow entering the sampling module at the top and bottom valves, respectively; wherein the first input is located at a position furthest away from the second input along the common inflow sampling line.

13. The system of claim 12, wherein the housing comprises one of a wireline tool or a multi-chamber sampling tool.

14. The system of claim 12, wherein the individual diversion valves are configured to enable selectively coupling a corresponding plurality of fluid passages from the set of fluid sampling chambers to the common inflow sampling line.

15. The system of claim 12, wherein at least some of the fluid sampling chambers comprise a pair of mutually-coupled sampling containment pistons, wherein the coupling mechanism between each pair of pistons serves to define a fixed volume of fluid to be received between that pair of pistons.

16. A processor-implemented method to execute on one or more processors that perform the method, comprising:

receiving, by a multi-chamber sampling tool, fluid flow and providing the fluid flow to a sampling module in the multi-chamber sampling tool;

terminating sampling of fluid into a first fluid sampling chamber of a set of fluid sampling chambers with a total volume of the set being less than a volume of the sampling module, the sampling module comprising a common inflow sampling line and the set of fluid chambers, the set of fluid sampling chambers sharing the common inflow sampling line by operating a set of closure mechanisms, wherein the common inflow sampling line is coupled to top and bottom valves which controls fluid flow into the common inflow sampling line, wherein the sampling module is removable from the multi-chamber sampling tool; and; and initiating sampling of the fluid into a second fluid sampling chamber of the set of fluid sampling chambers, wherein the fluid sampling chambers are configured to sample the fluid in the sampling line in a selected sequence, such that filling the first fluid sampling chamber as part of the sequence enables sampling in the second fluid sampling chamber as part of the sequence, and wherein the closure mechanisms comprise at least one of individual check valves, outlet valves, and a common diversion valve or individual diversion valves;

wherein the common inflow sampling line is arranged longitudinally in the sampling module; wherein the common inflow sampling line comprises first input and second input for receiving fluid flow entering the sampling module at the top and bottom valves, respectively; wherein the first input is located at a position furthest away from the second input along the common inflow sampling line.

17. The method of claim 16, further comprising:

operating the check valves as charged, irreversible valves.

18. The method of claim 16, further comprising:

regulating a differential pressure between hydrostatic pressure and sampling pressure in flow lines coupled to at least some of the fluid sampling chambers in the set so that a pressure imposed on the flow lines is less than the hydrostatic pressure.

19. The method of claim 16, further comprising:

receiving a pressure pulse in the common inflow sampling line to terminate sampling in the first fluid sampling chamber, or to initiate sampling in the second fluid sampling chamber.

20. A kit of parts to retrofit a multi-chamber sampling sub having a set of sampling modules, the kit comprising:

a set of fluid sampling chambers configured to share a common inflow sampling line coupled to top and bottom valves of a given sampling module which controls fluid flow into the common inflow sampling line, and wherein multiple ones of the fluid sampling chambers are sized to fit into at least one of the sampling modules, the multi-chamber sampling sub configured to allow fluid flow to the given sampling module in the multi-chamber sampling tool; the given sampling module including the set of fluid sampling chambers with a total volume of the set being less than a volume of the sampling module, and wherein the sampling module in the multi-chamber sampling tool is removable from the multi-chamber sampling sub; and a set of closure mechanisms having a one-to-one correspondence with the fluid sampling chambers, wherein the fluid sampling chambers are configured to sample fluid in the sampling line in a selected sequence, such that filling a first fluid sampling chamber in the selected sequence enables sampling in a second fluid sampling chamber in the selected sequence, and wherein the closure mechanisms comprise at least one of individual check valves, outlet valves, and a common diversion valve or individual diversion valves;

wherein the common inflow sampling line is arranged longitudinally in the given sampling module; wherein the common inflow sampling line comprises first input and second input for receiving fluid flow entering the given sampling module at the top and bottom valves, respectively; wherein the first input is located at a position furthest away from the second input along the common inflow sampling line.

21. The kit of claim 20, further comprising:

pairs of pistons to be disposed within at least some of the chambers, the pairs of pistons each comprising individual pistons mechanically coupled to each other by a coupling member having a fixed length.

22. The kit of claim 20, further comprising:

a set of flow lines to couple to at least some of the fluid sampling chambers, each of the flow lines comprising a sampling tap to enable individual access to a sample of the fluid trapped in a respective one of the flow lines.

* * * * *